US009303345B2

(12) United States Patent
Hasegawa et al.

(10) Patent No.: US 9,303,345 B2
(45) Date of Patent: Apr. 5, 2016

(54) CUTTING NEEDLE ROTATION DEVICE AND SEWING MACHINE

(71) Applicants: Katsuhisa Hasegawa, Kasugai (JP); Midori Magara, Nagoya (JP); Kiyokazu Sekine, Kuwana (JP); Harumi Kato, Nagoya (JP)

(72) Inventors: Katsuhisa Hasegawa, Kasugai (JP); Midori Magara, Nagoya (JP); Kiyokazu Sekine, Kuwana (JP); Harumi Kato, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 98 days.

(21) Appl. No.: 14/196,921

(22) Filed: Mar. 4, 2014

(65) Prior Publication Data

US 2014/0290547 A1 Oct. 2, 2014

(30) Foreign Application Priority Data

Mar. 29, 2013 (JP) ..... 2013-071535

(51) Int. Cl.
*D05B 37/08* (2006.01)
*D05B 19/14* (2006.01)

(52) U.S. Cl.
CPC ..... *D05B 37/08* (2013.01); *D05B 19/14* (2013.01)

(58) Field of Classification Search
CPC ..... D05B 19/12; D05B 37/08; D05B 19/14; D05C 9/06
See application file for complete search history.

(56) References Cited

U.S. PATENT DOCUMENTS

| | | | | |
|---|---|---|---|---|
| 6,006,685 | A * | 12/1999 | Kastrup et al. | 112/68 |
| 7,966,955 | B2 * | 6/2011 | Niizeki | 112/89 |
| 8,272,341 | B2 | 9/2012 | König et al. | |
| 8,671,860 | B2 * | 3/2014 | Kawaguchi et al. | 112/475.05 |
| 8,738,169 | B2 * | 5/2014 | Muto et al. | 700/137 |
| 8,738,172 | B2 * | 5/2014 | Muto et al. | 700/138 |
| 8,739,712 | B2 * | 6/2014 | Kawaguchi et al. | 112/470.01 |
| 8,978,566 | B2 * | 3/2015 | Hasegawa et al. | 112/470.05 |
| 9,051,670 | B2 * | 6/2015 | Okuyama | |
| 9,068,287 | B2 * | 6/2015 | Kato | |
| 2010/0050915 | A1 * | 3/2010 | Konig et al. | 112/89 |
| 2011/0088605 | A1 * | 4/2011 | Kawaguchi et al. | 112/470.01 |

* cited by examiner

*Primary Examiner* — Danny Worrell
(74) *Attorney, Agent, or Firm* — Oliff PLC

(57) ABSTRACT

A cutting needle rotation device includes a mounting portion, a first member, a moving member, and a rotation mechanism. The mounting portion is removably mounted on a needle bar of a sewing machine. The first member is a member to which a cutting needle is affixed. The moving member is positioned in a first position when the moving member does not receive an external force and moves to a second position when the moving member receives an external force. The rotation mechanism, when the moving member is in the first position, holds the first member such that the cutting needle does not rotate, and when the moving member moves from the first position to the second position and returns from the second position to the first position, rotates the first member such that the cutting needle rotates by a specified angle of rotation in one direction.

4 Claims, 27 Drawing Sheets

FIG. 16

100

| CUT WORK PATTERN DATA | | | | |
|---|---|---|---|---|
| NEEDLE DROP POINT NUMBER: N | X COORDINATE | Y COORDINATE | CUT ANGLE | CUTTING NEEDLE ANGLE NUMBER |
| 1 | x1 | y1 | 45° | 2 |
| 2 | x2 | y2 | 45° | 2 |
| 3 | x3 | y3 | 45° | 2 |
| 4 | x4 | y4 | 45° | 2 |
| 5 | x5 | y5 | 45° | 2 |
| 6 | x6 | y6 | 0° | 1 |
| 7 | x7 | y7 | 0° | 1 |
| 8 | x8 | y8 | 0° | 1 |
| 9 | x9 | y9 | 90° | 3 |
| 10 | x10 | y10 | 90° | 3 |
| 11 | x11 | y11 | 90° | 3 |
| 12 | x12 | y12 | 90° | 3 |
| 13 | x13 | y13 | 135° | 4 |
| 14 | x14 | y14 | 135° | 4 |
| 15 | x15 | y15 | 135° | 4 |
| ⋮ | ⋮ | ⋮ | ⋮ | ⋮ |
| ⋮ | ⋮ | ⋮ | ⋮ | ⋮ |
| ⋮ | ⋮ | ⋮ | ⋮ | ⋮ |
| CUT_END | ⋮ | ⋮ | ⋮ | ⋮ |

| CUT ANGLE - NEEDLE ANGLE NUMBER CORRESPONDENCE DATA | |
|---|---|
| CUT ANGLE | CUTTING NEEDLE ANGLE NUMBER |
| 0° | 1 |
| 45° | 2 |
| 90° | 3 |
| 135° | 4 |

FIG. 18

102

| CUTTING NEEDLE ANGLE CHANGE POSITION DATA | |
|---|---|
| CHANGE NEEDLE DROP POINT NUMBER: CN | CUTTING NEEDLE ANGLE NUMBER |
| 6 | 1 |
| 9 | 3 |
| 13 | 4 |
| ⋮ | ⋮ |
| ⋮ | ⋮ |
| ⋮ | ⋮ |

CUTTING NEEDLE ROTATION DEVICE AND SEWING MACHINE

CROSS-REFERENCE TO RELATED APPLICATION

This Application claims priority to Japanese Patent Application No. 2013-071535, filed on Mar. 29, 2013, the content of which is hereby incorporated by reference.

BACKGROUND

The present disclosure relates to a cutting needle rotation device that rotates a cutting needle and to a sewing machine in which the cutting needle rotation device is provided.

A sewing machine is known that automatically rotates a cutting needle that is mounted on a needle bar. The cutting needle that is mounted on the needle bar of the sewing machine is supported such that it can rotate in 45-degree increments. In the sewing machine, the cutting needle is automatically rotated by the moving of an embroidery frame in a state in which a coupling portion that is provided in the embroidery frame is engaged with a gear portion that is provided in the cutting needle and by the swinging of the needle bar to one of the left and the right in a state in which a coupling portion that is provided in a presser bar is engaged with the gear portion that is provided in the cutting needle.

SUMMARY

However, with the sewing machine that is described above, a problem exists in that it is necessary for the coupling portion in the embroidery frame to be provided and for the coupling portion in the presser bar to be provided, so additional structures other than the cutting needle are required.

Various embodiments of the present disclosure provide a cutting needle rotation device that can automatically rotate a cutting needle, and a sewing machine in which the cutting needle rotation device is provided, without requiring that additional structures be provided on an embroidery frame and a presser bar.

A cutting needle rotation device according to a first embodiment of the present disclosure is provided with the cutting needle rotation device that includes a mounting portion, a first member, a moving member, and a rotation mechanism. The mounting portion is configured to be removably mounted on a needle bar of a sewing machine. The first member is a member to which a cutting needle is affixed at an opposite end of the first member from the mounting portion. The cutting needle is provided with a cutting edge. The moving member is positioned in a first position when the moving member does not receive an external force and that moves to a second position when the moving member receives an external force. The rotation mechanism, when the moving member is in the first position, holds the first member such that the cutting needle does not rotate about an axis of the cutting needle and, when the moving member moves from the first position to the second position and returns from the second position to the first position, rotates the first member such that the cutting needle rotates about the axis of the cutting needle axis by a specified angle of rotation in one direction.

A sewing machine according to a second embodiment of the present disclosure is provided with the cutting needle rotation device. The cutting needle rotation device includes a mounting portion, a first member, a moving member, and a rotation mechanism. The mounting portion is configured to be removably mounted on a needle bar of the sewing machine. The first member is a member to which a cutting needle is affixed at an opposite end of the first member from the mounting portion. The cutting needle is provided with a cutting edge. The moving member is positioned in a first position when the moving member does not receive an external force and that moves to a second position when the moving member receives an external force. The rotation mechanism, when the moving member is in the first position, holds the first member such that the cutting needle does not rotate about an axis of the cutting needle and, when the moving member moves from the first position to the second position and returns from the second position to the first position, rotates the first member such that the cutting needle rotates about the axis of the cutting needle axis by a specified angle of rotation in one direction.

BRIEF DESCRIPTION OF THE DRAWINGS

Embodiments will be described below in detail with reference to the accompanying drawings in which:

FIG. 16 is a figure that shows the content of cut work pattern data 100;

FIG. 18 is a figure that shows the content of cutting needle angle change position data 102;

DETAILED DESCRIPTION

Figure 1:
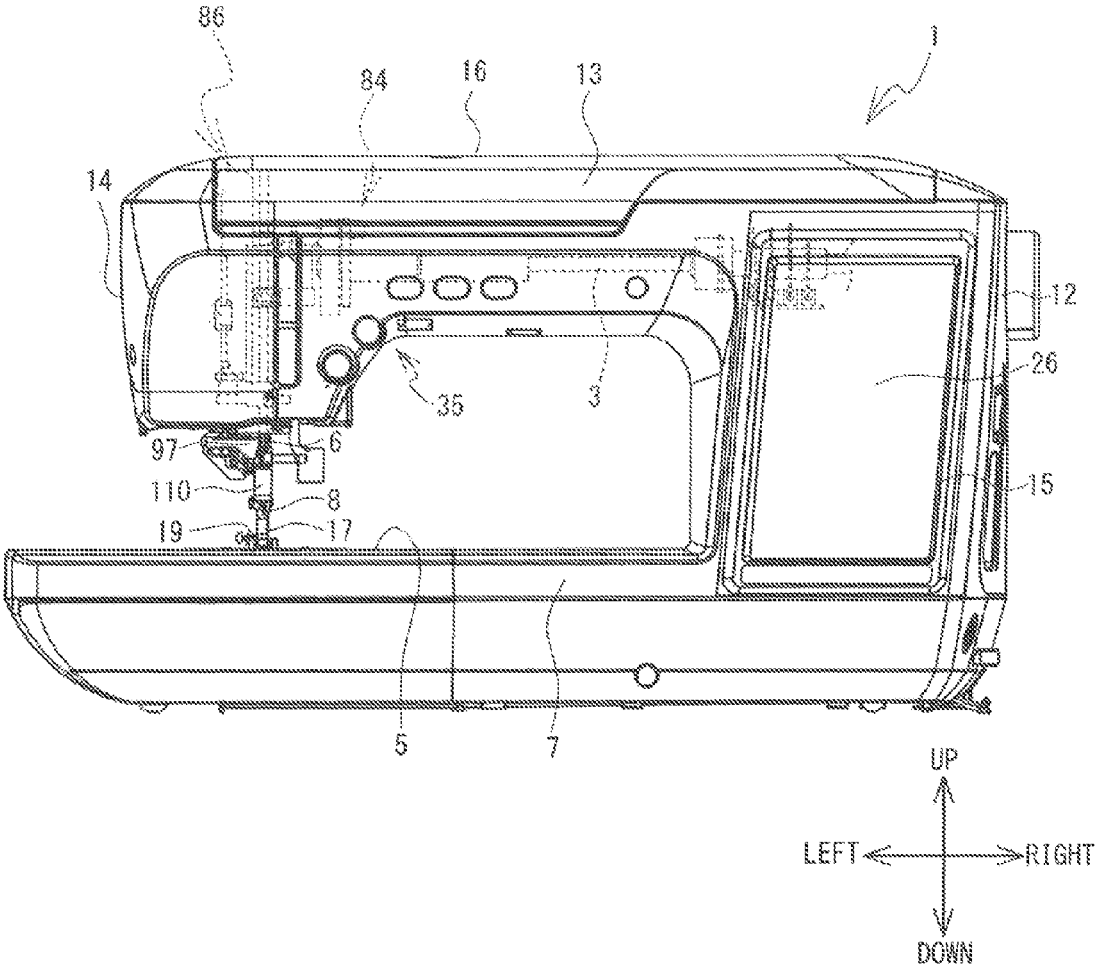
FIG. 1 is a front view of a sewing machine 1.

Hereinafter, a sewing machine 1 according to an embodiment of the present disclosure will be explained with reference to the drawings. The sewing machine 1 performs sewing and cut work on a cloth (not shown in the drawings). The cut work is an operation that forms a pattern in the cloth by cutting out specified areas of the cloth.

The configuration of the sewing machine 1 will be explained with reference to FIG. 1. The front side, the rear side, the left side, the right side, the top side, and the bottom side in FIG. 1 respectively define the front side, the rear side, the left side, the right side, the top side, and the bottom side of the sewing machine 1. The left-right direction in the sewing machine 1 defines an X axis direction, and the front-rear direction defines a Y axis direction.

As shown in FIG. 1, the sewing machine 1 is provided with a bed 7, a pillar 12, an arm 13, and a head 14. The bed 7 is the base of the sewing machine 1 and extends in the left-right direction. An embroidery frame moving mechanism that is not shown in the drawings can be removably mounted on the bed 7. The pillar 12 is provided such that it extends upward from the right end of the bed 7. The arm 13 extends to the left from the top end of the pillar 12. The head 14 is provided on the left end of the arm 13. A needle plate 5 is provided in the top face of the bed 7. A feed dog (not shown in the drawings), a feed mechanism 85 (refer to FIG. 15), a feed motor 80 (refer to FIG. 15), and a shuttle mechanism (not shown in the drawings) are provided inside the bed 7 underneath the needle plate 5. The feed dog moves a cloth that is placed on the top side of the bed 7 by a specified feed amount. The feed mechanism 85 drives the feed dog. The feed motor 80 is a pulse motor that drives the feed mechanism 85. The shuttle mechanism is a mechanism that is configured such that, in a case where a sewing needle (not shown in the drawings) is mounted on the lower end of a needle bar 6, which will be described later, the shuttle mechanism operates in conjunction with the sewing needle to form a stitch in a sewing workpiece.

A liquid crystal display 15 whose shape is a vertical rectangle is provided on the front face of the pillar 12. An image that includes various types of items, such as various types of sewing patterns and cut work patterns, commands that execute various types of functions, various types of messages, and the like, is displayed on the liquid crystal display 15. A transparent touch panel 26 is provided on the front face of the liquid crystal display 15. By using a finger or a special touch pen to touch a location on the touch panel 26 that corresponds to an item that is displayed on the liquid crystal display 15, a user is able to select or input a desired sewing pattern, cut work pattern, or command to be executed.

The configuration of the arm 13 will be explained. Operation switches 35 that include a cut work start switch and the like are provided in the lower portion of the front face of the arm 13. An opening and closing cover 16 is provided in the upper portion of the arm 13. The opening and closing cover 16 is axially supported by a rotating shaft (not shown in the drawings) that extends in the left-right direction. The rotating shaft is provided in the upper rear edge portion of the arm 13. A spool containing portion (not shown in the drawings) that contains a thread spool (not shown in the drawings) that supplies an upper thread (not shown in the drawings) is provided under the cover 16, that is, in the interior of the arm 13. The upper thread that extends from the thread spool is supplied to the sewing needle that is not shown in the drawings by way of a thread guard portion that includes a tensioner, a thread take-up spring, a thread take-up lever, and the like that are not shown in the drawings. The tensioner is provided in the head 14 and adjusts the thread tension. The thread take-up lever is operated such that it moves reciprocally up and down, and it pulls the upper thread upward. One of the sewing needle and a cutting needle rotation device 110 can be mounted on the lower end of the needle bar 6 that is provided in the lower portion of the head 14. In a case where the sewing machine 1 will perform a sewing operation, the sewing needle is mounted, and in a case where the sewing machine 1 will perform cut work, the cutting needle rotation device 110 is mounted. The needle bar 6 is driven by a needle bar up-and-down moving mechanism 84 that is provided inside the head 14 such that needle bar 6 moves up and down. The needle bar up-and-down moving mechanism 84 is driven by a drive shaft 3 that is rotationally driven by a sewing machine motor 79 (refer to FIG. 15). In other words, the needle bar 6 is driven by the sewing machine motor 79 and the needle bar up-and-down moving mechanism 84.

Figure 2:
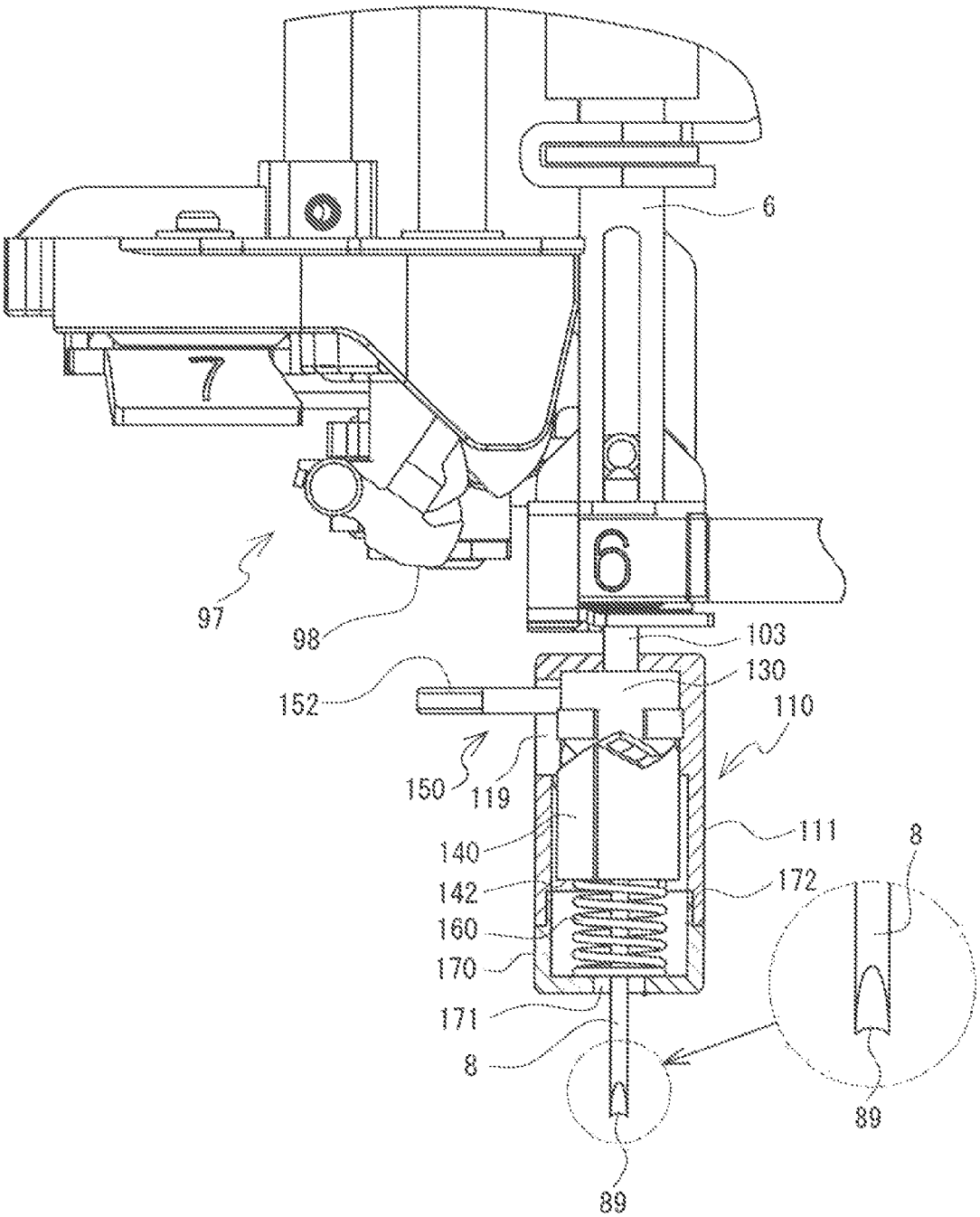
FIG. 2 is an enlarged view of a main portion of the sewing machine 1 in the area around a cutting needle rotation device 110.

As shown in FIGS. 1 and 2, the cutting needle rotation device 110 is removably mounted on the lower end of the needle bar 6. The cutting needle rotation device 110 supports a cutting needle 8 that extends in the up-down direction such that the cutting needle 8 can rotate. When cut work is performed using the cutting needle 8, a cutting edge 89 of the cutting needle 8 is moved downward from above the cloth (not shown in the drawings), and a specified cut is formed in the cloth that corresponds to the shape and the orientation of the cutting edge 89. The configuration of the cutting needle rotation device 110 will be described in detail later.

A presser bar 17 is provided to the rear of the needle bar 6. The presser bar 17 is moved up and down by the driving of a presser mechanism 90 (refer to FIG. 15) that is provided in the interior of the head 14 by a presser motor 99 (refer to FIG. 15). A presser holder (not shown in the drawings) is attached to the lower end of the presser bar 17. A presser foot 19 that presses on the cloth is removably mounted in the presser holder.

An automatic threading mechanism 97 is provided to the left of the needle bar 6. The automatic threading mechanism 97 is moved up and down by being driven by a threading motor 96 (refer to FIG. 15) that is provided in the interior of the head 14.

Figure 3:
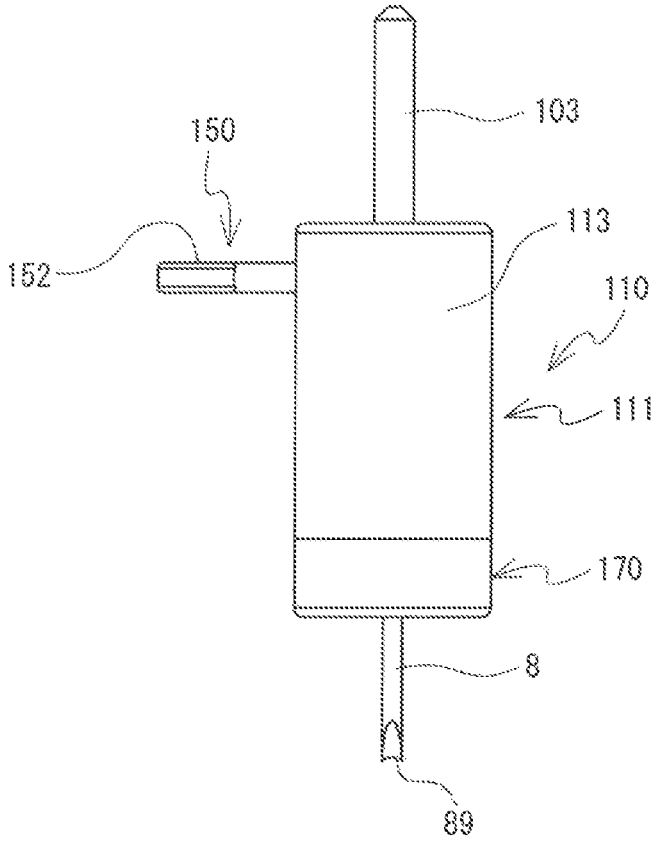
FIG. 3 is a front view of the cutting needle rotation device 110.
Figure 4:
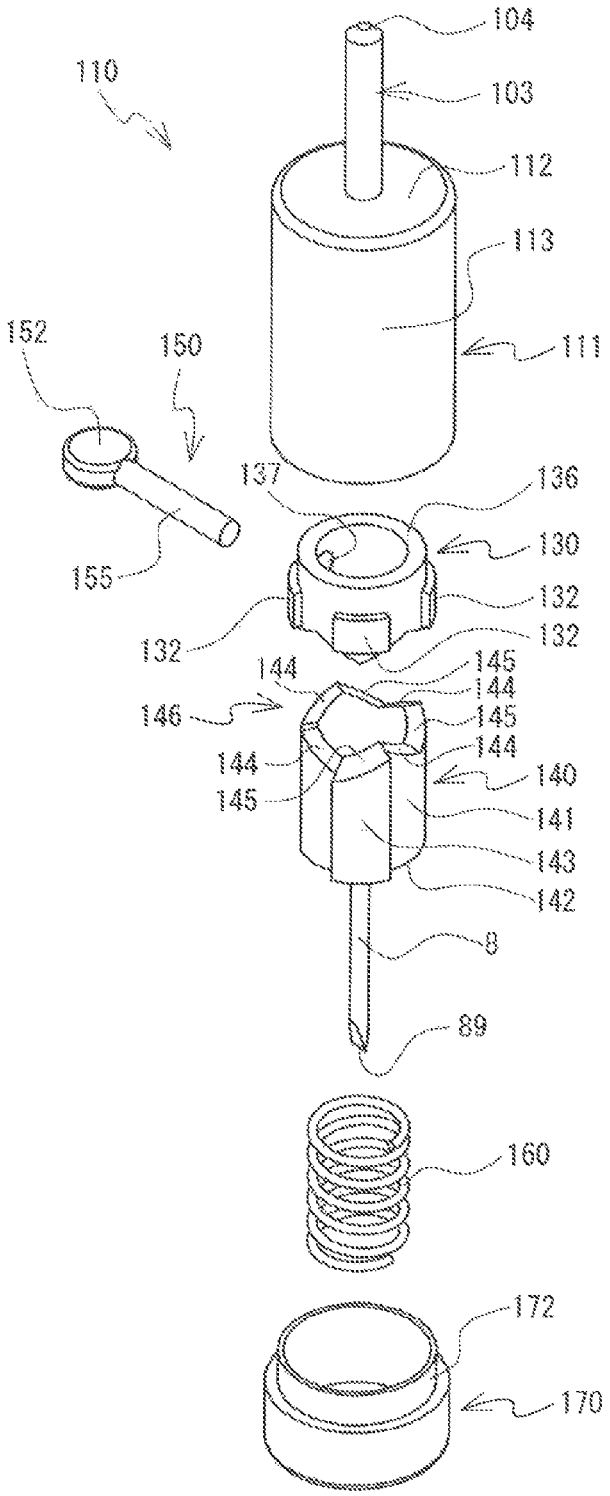
FIG. 4 is an exploded oblique view of the cutting needle rotation device 110.

The configuration of the cutting needle rotation device 110 will be explained with reference to FIGS. 2 to 4. The cutting needle rotation device 110 is a device that rotates the cutting needle 8, which will be described later, in 45-degree increments in a plan view. However, in the explanations that refer to FIG. 2, FIGS. 4 to 14, and FIG. 19, to facilitate showing the shapes of the individual structural members of the cutting needle rotation device 110 in a way that is easy to understand, the cutting needle rotation device 110 will be explained as having a configuration that rotates the cutting needle 8 in 90-degree increments in a plan view. The cutting needle rotation device 110 is provided with a first member 140, a second member 130, a third member 111, a moving member 150, a spring 160, and a cover member 170. The cylindrical third member 111 is supported by the needle bar 6 through a support shaft 103, and the spring 160, the first member 140, and the second member 130 are accommodated in the interior of the third member 111, in that order from bottom to top. Hereinafter, individual structures of the cutting needle rotation device 110 will be described in detail.

Figure 5:
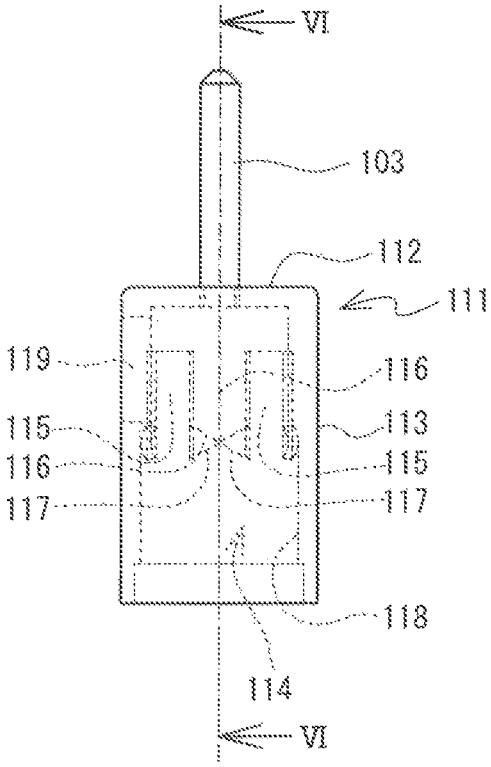
FIG. 5 is a front view of a third member 111 of the cutting needle rotation device 110.
Figure 6:
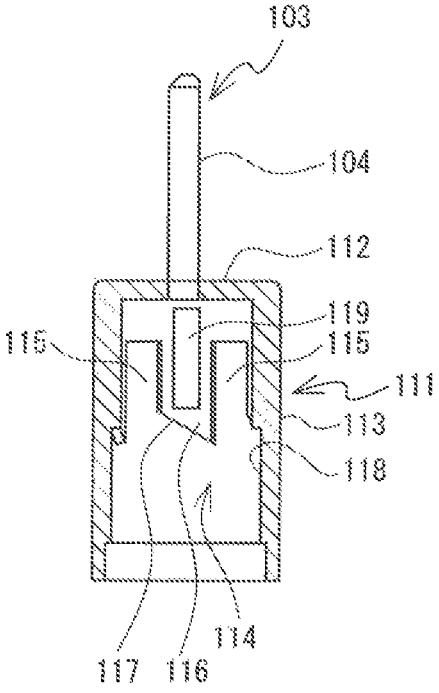
FIG. 6 is a vertical section view of the third member 111 as seen from the direction of arrows on a line VI-VI in FIG. 5.
Figure 7:
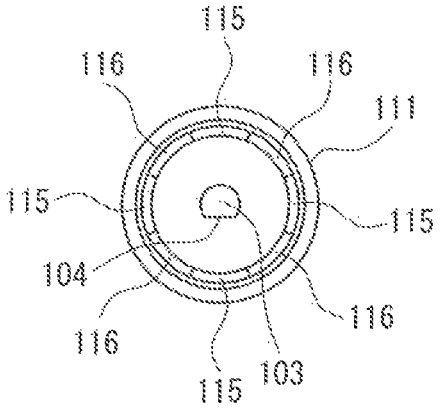
FIG. 7 is a bottom view of the third member 111.
Figure 8:
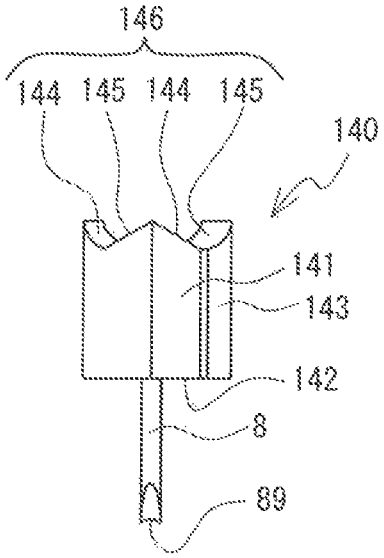
FIG. 8 is a front view of a first member 140 of the cutting needle rotation device 110.
Figure 9:
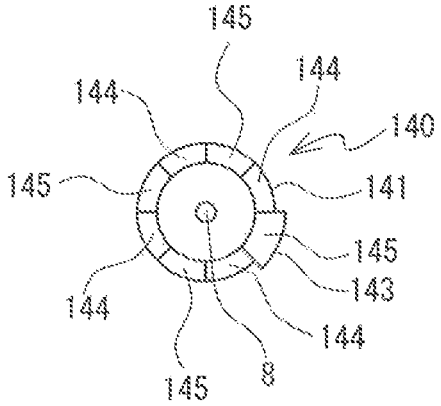
FIG. 9 is a plan view of the first member 140.
Figure 10:
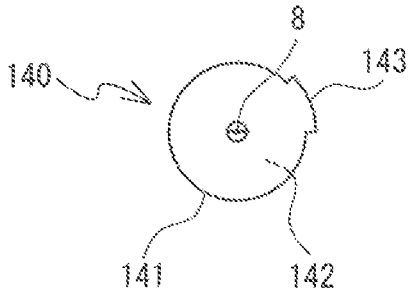
FIG. 10 is a bottom view of the first member 140.
Figure 11:
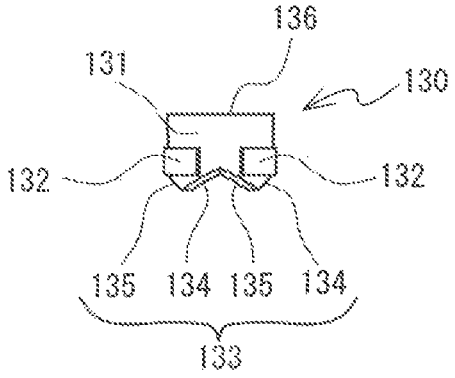
FIG. 11 is a front view of a second member 130 of the cutting needle rotation device 110.

The third member 111 will be explained with reference to FIGS. 2 to 7. The third member 111 forms a housing of the cutting needle rotation device 110, and it is constructed from a cylindrical portion 113, a top face 112 that covers the upper end of the cylindrical portion 113, and the support shaft 103, which is fastened to a central portion of the top face 112. As shown in FIGS. 2 to 6, an opening 119 whose shape is a vertical rectangle (refer to FIG. 6) is formed in the cylindrical portion 113, and a shaft portion 155 of the moving member 150, which will be described later, extends through the opening 119 and can move up and down. Furthermore, as shown in FIGS. 5 to 7, an expanded diameter portion 118, whose diameter has been widened, is formed in a lower half of an interior portion 114 of the cylindrical portion 113. In an upper half of the interior portion 114 of the cylindrical portion 113, recessed portions 115, all of which are formed to have a specified length in the up-down direction, are provided in four locations at 90-degree intervals. A first projecting portion 143 of the first member 140 and second projecting portions 132 of the second member 130, which will both be described later, fit into the recessed portions 115 such that the projecting portions can move up and down. An inclined surface 117 is formed between the bottom edges of inner wall surfaces 116 of each pair of neighboring recessed portions 115. The support shaft 103 has a substantially columnar shape, and a flat surface 104 is formed in a portion of the outer circumferential surface of the support shaft 103. When the support shaft 103 is affixed to the needle bar 6, it is mounted such that the flat surface 104 faces in a specified direction, which, in the present embodiment, is toward the rear of the sewing machine 1. The configuration that is described above means that the support shaft 103, that is, the third member 111, is mounted on the needle bar 6 in a specified orientation. When the third member 111 is mounted on the needle bar 6, the opening 119 is positioned on the left side, and the shaft portion 155 extends to the left through the opening 119. As will be explained in detail later, the orientation of the cutting edge 89 of the cutting needle 8 is also set by the mounting of the third member 111 on the needle bar 6 in the specified orientation.

Next, the first member 140 will be explained with reference to FIG. 4 and FIGS. 8 to 10. The first member 140 is configured from a cylindrical portion 141, a bottom face 142, and a first cam 146. The bottom face 142 is formed on the bottom end of the cylindrical portion 141. The cutting needle 8, which has the cutting edge 89, is affixed to a central portion of the bottom face 142 such that the axis of the cutting needle 8 extends in the up-down direction. The bottom face 142 serves as a needle anchoring portion. The first cam 146 is formed along the upper edge of the cylindrical portion 141. The first cam 146 is made up of four pairs of inclined surfaces 144 and inclined surfaces 145 that form a series of peaks and valleys. The four pairs of the inclined surfaces 144 and the inclined surfaces 145 are formed such that they face upward around the circumference of the cylindrical portion 141. Therefore, the combination of one inclined surface 144 and one inclined surface 145 that forms one pair covers a 90-degree angle range within the circumference of the cylindrical portion 141. The first projecting portion 143 is formed on the cylindrical portion 141 such that it projects a specified distance outward from the outer circumferential surface of the cylindrical portion 141.

Figure 12:
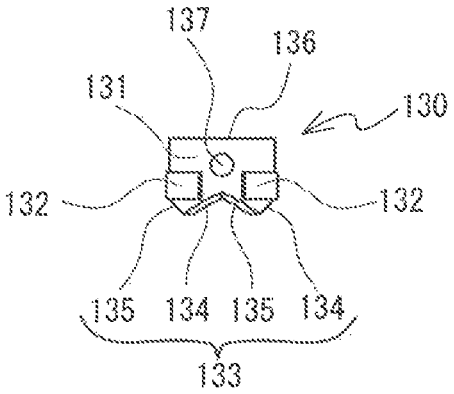
FIG. 12 is a left side view of the second member 130.
Figure 13:
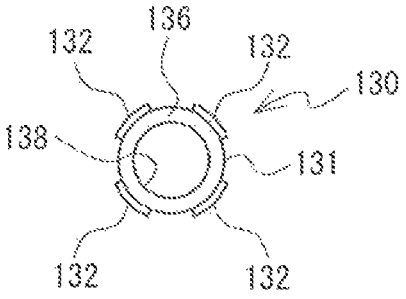
FIG. 13 is a plan view of the second member 130.
Figure 14:
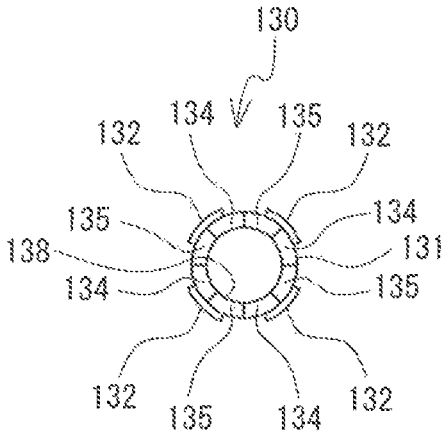
FIG. 14 is a bottom view of the second member 130.

Next, the second member 130 will be explained with reference to FIG. 4 and FIGS. 11 to 14. The second member 130 is configured from a cylindrical portion 131, a second cam 133, and the second projecting portions 132. The second cam 133 is provided along the bottom edge of the second member 130. The second projecting portions 132 are rectangular in a front view, and four of them are provided around the outer circumferential face of the cylindrical portion 131. The four second projecting portions 132 are positioned at 90-degree intervals around the circumference of the cylindrical portion 131, and they project outward from the outer circumferential surface of the cylindrical portion 131. The second cam 133 is made up of four pairs of inclined surfaces 134 and inclined surfaces 135 that form a series of peaks and valleys. The four pairs of the inclined surfaces 134 and the inclined surfaces 135 are formed such that they face downward around the circumference of the cylindrical portion 131. Therefore, the combination of one inclined surface 134 and one inclined surface 135 that forms one pair covers a 90-degree angle range within the circumference of the cylindrical portion 131. As shown in FIG. 12, a round hole 137 is formed in the left side face of the cylindrical portion 131. The tip of the shaft portion 155 of the moving member 150, which will be described later, is inserted into the hole 137 and secured. A top end portion 136 of the second member 130 is formed to be flat. The inner side of the second member 130 serves as an opening 138.

Next, the moving member 150 will be explained with reference to FIG. 4. The moving member 150 is configured from the rod-shaped shaft portion 155 and a disc-shaped contact portion 152 that is provided on the end of the shaft portion 155. A threading member 98 that is provided on the lower edge of the automatic threading mechanism 97 comes into contact with the contact portion 152 (refer to FIG. 20).

Next, the cover member 170 will be explained with reference to FIGS. 2 and 4. The cover member 170 is a bottom cover that is affixed to the bottom end of the third member 111. The cover member 170 is provided with a mounting portion 172 that is affixed to the bottom end of the third member 111 and with a through-hole 171 through which the cutting needle 8 passes. In addition, the coil-shaped spring 160 is provided between the cover member 170 and the bottom face 142 of the first member 140. The spring 160 energizes the first member 140, together with the second member 130, in the direction of the top face 112 and support shaft 103.

An electrical configuration of the sewing machine 1 will be explained with reference to FIG. 15. A control portion 105 of the sewing machine 1 is provided with a CPU 151, a ROM 154, a RAM 153, a flash memory 64, and an input/output interface 66. The CPU 151, the ROM 154, the RAM 153, the flash memory 64, and the input/output interface 66 are electrically connected to one another through a bus 67. Various types of programs are stored in the ROM 154, including programs that the CPU 151 executes to perform cut work processing, needle angle rotation processing, and the like that will be described later. Various types of information that are processed by the programs are temporarily stored in RAM 63.

A cut work data storage area 641, a cut angle-needle angle number correspondence data storage area 642, a cutting needle angle change position data storage area 643, a start-up mode storage area 644, a cutting needle angle number storage area 645, a cut work program storage area 646, and the like are provided in the flash memory 64. Cut work pattern data 100 (refer to FIG. 16), which will be described later, are stored in the cut work data storage area 641. Cut angle-needle angle number correspondence data 101 (refer to FIG. 17), which will be described later, are stored in the cut angle-needle angle number correspondence data storage area 642. Cutting needle angle change position data 102 (refer to FIG. 18), which will be described later, are stored in the cutting needle angle change position data storage area 643. A sewing mode by which the sewing machine 1 performs ordinary sewing and a cut work mode by which the sewing machine 1 performs cut work are stored in the start-up mode storage area 644. A cutting needle angle number, which will be described later, is stored in the cutting needle angle number storage area 645. A program for performing the cut work processing, which will be described later, is stored in the cut work program storage area 646.

In the explanation that follows, a cut angle is the angle that is formed between a width direction of the cutting edge 89 of the cutting needle 8 and a reference direction (the left-right direction) in a plan view. In a state in which the cutting edge 89 extends in the left-right direction (the state of the cutting edge 89 in FIG. 2), the cut angle is zero degrees, and in a plan view, the direction of counterclockwise rotation from the state of the cutting edge 89 in FIG. 2 is the positive direction. The cut angle when the cutting needle 8 is first mounted on the needle bar 6 is defined as being zero degrees.

Figure 15:
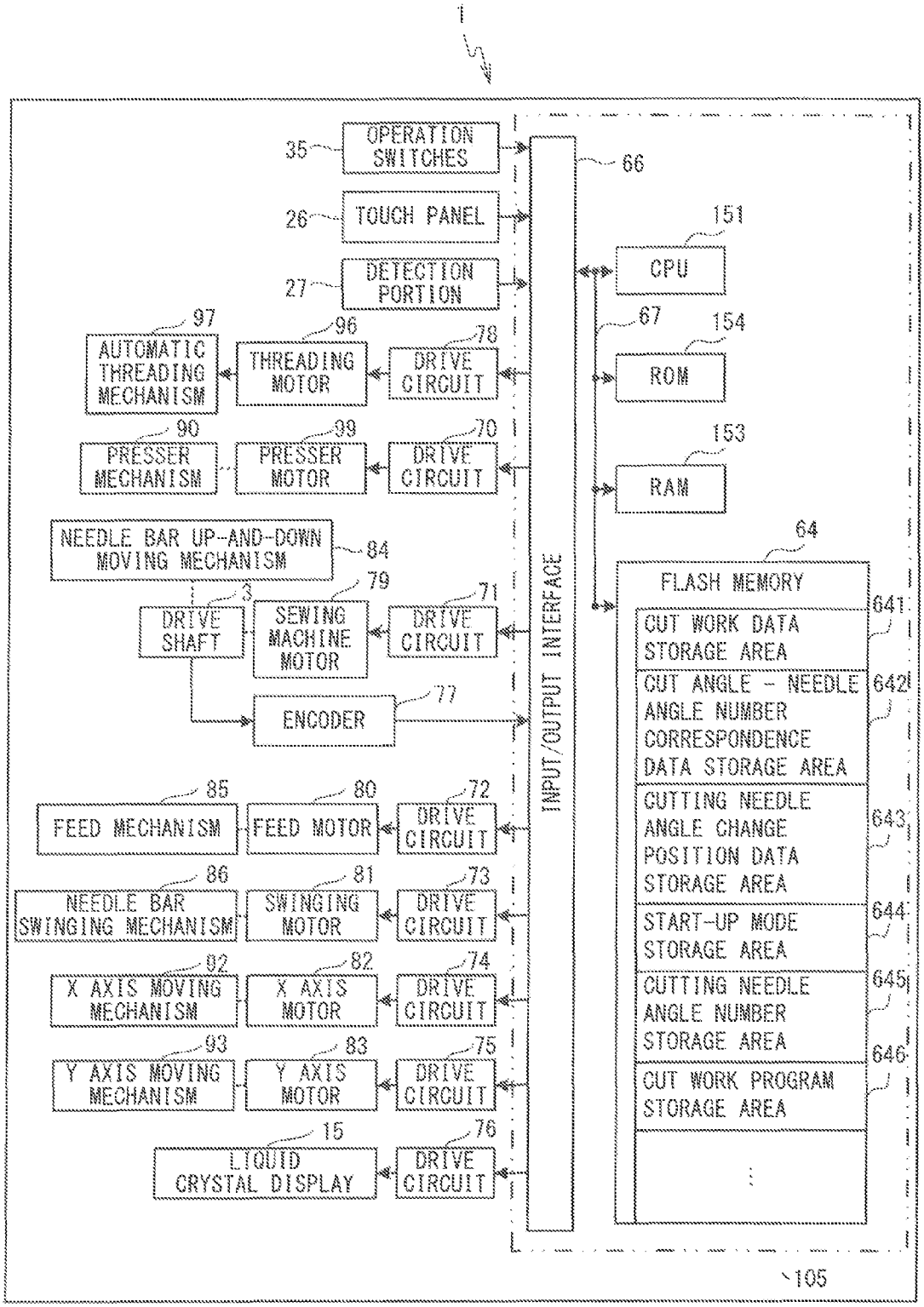
FIG. 15 is a block diagram that shows an electrical configuration of the sewing machine 1.

As shown in FIG. 15, the operation switches 35, the touch panel 26, a detection portion 27, drive circuits 70 to 76, and a drive circuit 78 are electrically connected to the input/output interface 66. The detection portion 27 detects a type of an embroidery frame (not shown in the drawings) that is mounted on the embroidery frame moving mechanism (not shown in the drawings), then transmits the detection result to the CPU 151 through the input/output interface 66. The drive circuits 70 to 76 respectively operate the presser motor 99, the sewing machine motor 79, the feed motor 80, a swinging motor 81, an X axis motor 82, a Y axis motor 83, and the liquid crystal display 15. The drive circuit 78 operates the threading motor 96. The threading motor 96 drives the automatic threading mechanism 97 and moves the threading member 98 of the automatic threading mechanism 97 up and down. The presser motor 99 drives the presser mechanism 90. The sewing machine motor 79, by rotating the drive shaft 3, drives the needle bar up-and-down moving mechanism 84. The feed motor 80 drives the feed mechanism 85 that moves the feed dog. The swinging motor 81 drives a needle bar swinging mechanism 86. The X axis motor 82 drives an X axis moving mechanism 92 that is not shown in the drawings. The Y axis motor 83 drives a Y axis moving mechanism 93 of the embroidery frame that is not shown in the drawings.

An encoder 77 is a detector that detects the rotation angle of the drive shaft 3. The encoder 77 detects the rotation angle of the drive shaft 3 and transmits it to the CPU 151 through the input/output interface 66.

The cut work pattern data 100 will be explained with reference to FIG. 16. The cut work pattern data 100 are data that the CPU 151 references during the cut work processing, which will be described later. The cutting edge 89 of the cutting needle 8 extends in a direction (the left-right direction in FIG. 2) that is orthogonal to the axis of the cutting needle 8, so the direction of the cut that is formed in the cloth (not shown in the drawings) by the cutting needle 8 is the left-right direction. Therefore, in order for the cutting needle 8 to be used to cut out the cloth along the outline of a pattern shape that is made up of curved lines, it is necessary for the orientations of the cuts that are formed in the cloth to be changed by rotating the cutting needle 8 in conjunction with the moving of the embroidery frame (not shown in the drawings) in the X axis direction and the Y axis direction. The cut work pattern data 100 are data for forming the specified pattern and the like by cutting out the cloth. One set of the cut work pattern data 100 is stored in the cut work data storage area 641 for each cut work pattern that the sewing machine 1 will form on the cloth.

As shown in FIG. 16, various data items, including a needle drop point number N, X coordinate and Y coordinate data, a cut angle, and a cutting needle angle number, are stored in association with one another in the cut work pattern data 100. The needle drop point number N is a variable that indicates the order in which the cloth will be cut. The value "CUT_END" that is shown in the last field for the needle drop point number N indicates the final needle drop point number N and represents a number such as "200", "300", or the like, for example. In the explanation that follows, "CUT_END" is defined as the maximum value for the needle drop point number N in the cut work pattern data 100. The X coordinate data and the Y coordinate data are data that are set in advance and that indicate the coordinates of the needle drop points (the points where the center point of the cutting edge 89 will pierce the cloth) in an embroidery coordinate system that is specific to the sewing machine 1. Note that in the sewing machine 1, the position where the center point of the embroidery frame (not shown in the drawings) is congruent with the needle drop point is defined as the origin point of the embroidery coordinate system. The cut angle is data on the angle that is formed between the width direction of the cutting edge 89 of the cutting needle 8 and the reference direction in a plan view. The cutting needle angle number is a number that is associated with the cut angle data. The cutting needle angle number "1" corresponds to a cut angle of zero degrees. The cutting needle angle number "2" corresponds to a cut angle of 45 degrees. The cutting needle angle number "3" corresponds to a cut angle of 90 degrees. The cutting needle angle number "4" corresponds to a cut angle of 135 degrees.

Figure 17:
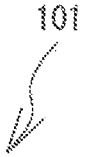
FIG. 17 is a figure that shows the content of cut angle-needle angle number correspondence data 101.

The cut angle-needle angle number correspondence data 101 will be explained with reference to FIG. 17. The cut angle-needle angle number correspondence data 101 are data that the CPU 151 references during processing that will be described later. The cut angle-needle angle number correspondence data 101 include fields for the cut angle and the cutting needle angle number. The cut angle of zero degrees corresponds to the cutting needle angle number "1". The cut angle of 45 degrees corresponds to the cutting needle angle number "2". The cutting needle angle number "3" corresponds to the cut angle of 90 degrees. The cut angle of 135 degrees corresponds to the cutting needle angle number "4".

The cutting needle angle change position data 102 will be explained with reference to FIG. 18. The cutting needle angle change position data 102 are data that the CPU 151 references during processing that will be described later. A change needle drop point number CN and the cutting needle angle number are stored in association with one another in the cutting needle angle change position data 102. For example, a change needle drop point number CN of "6" is associated with the cutting needle angle number "1", a change needle drop point number CN of "9" is associated with the cutting needle angle number "3", and a change needle drop point number CN of "13" is associated with the cutting needle angle number "4".

Figure 19:
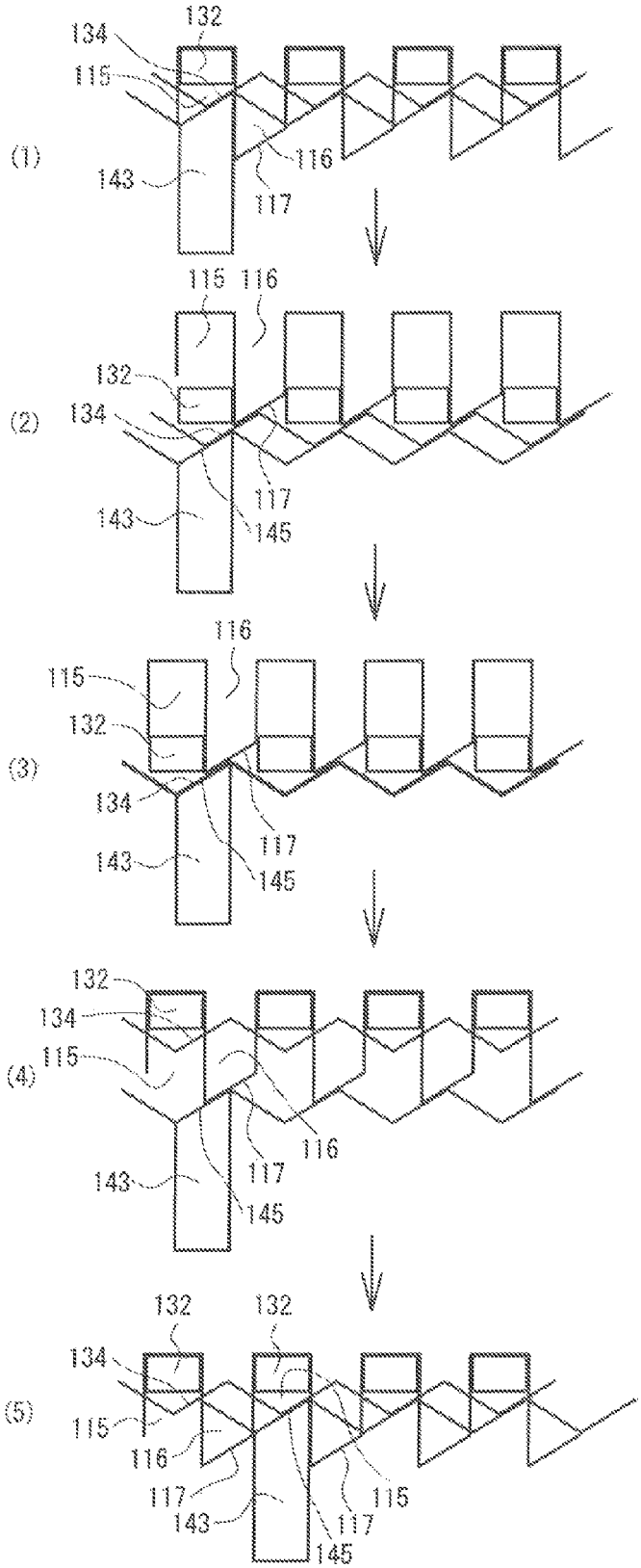
FIG. 19 is a development view of the third member 111 that explains the principle of the cutting needle rotation device 110.

Next, the principle of the operation of the cutting needle rotation device 110 will be explained with reference to FIG. 2 and FIGS. 19 to 21. Cut work that is performed using the cutting needle 8 is performed in a state in which the threading member 98 of the automatic threading mechanism 97 is raised and is not in contact with the contact portion 152 of the moving member 150 of the cutting needle rotation device 110, as shown in FIG. 2. In the state described above, the second projecting portions 132 of the second member 130 fit into the corresponding recessed portions 115 of the third member 111 and, receiving the upward energizing force of the spring 160, move upward to the upper ends of the recessed portions 115, as shown in FIG. 19 (1). The upper end of the first projecting portion 143 of the first member 140 fits into one of the four recessed portions 115 of the third member 111. Therefore, the first member 140 is locked such that it cannot rotate around the axis of the support shaft 103 in relation to third member 111. In this state, the needle bar 6 is lowered and the cut work is performed.

Figure 20:
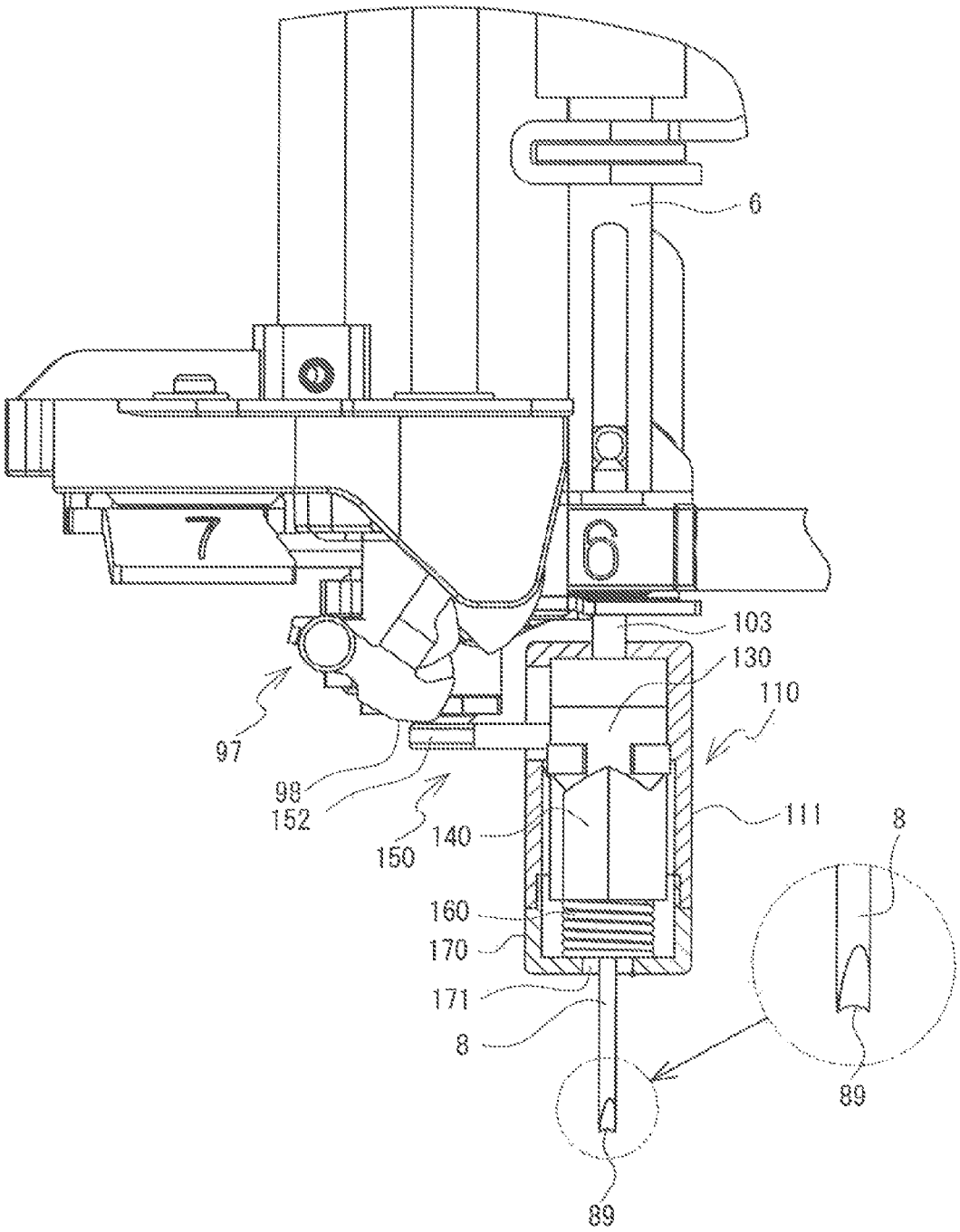
FIG. 20 is a front view that shows operation of the cutting needle rotation device 110.
Figure 21:
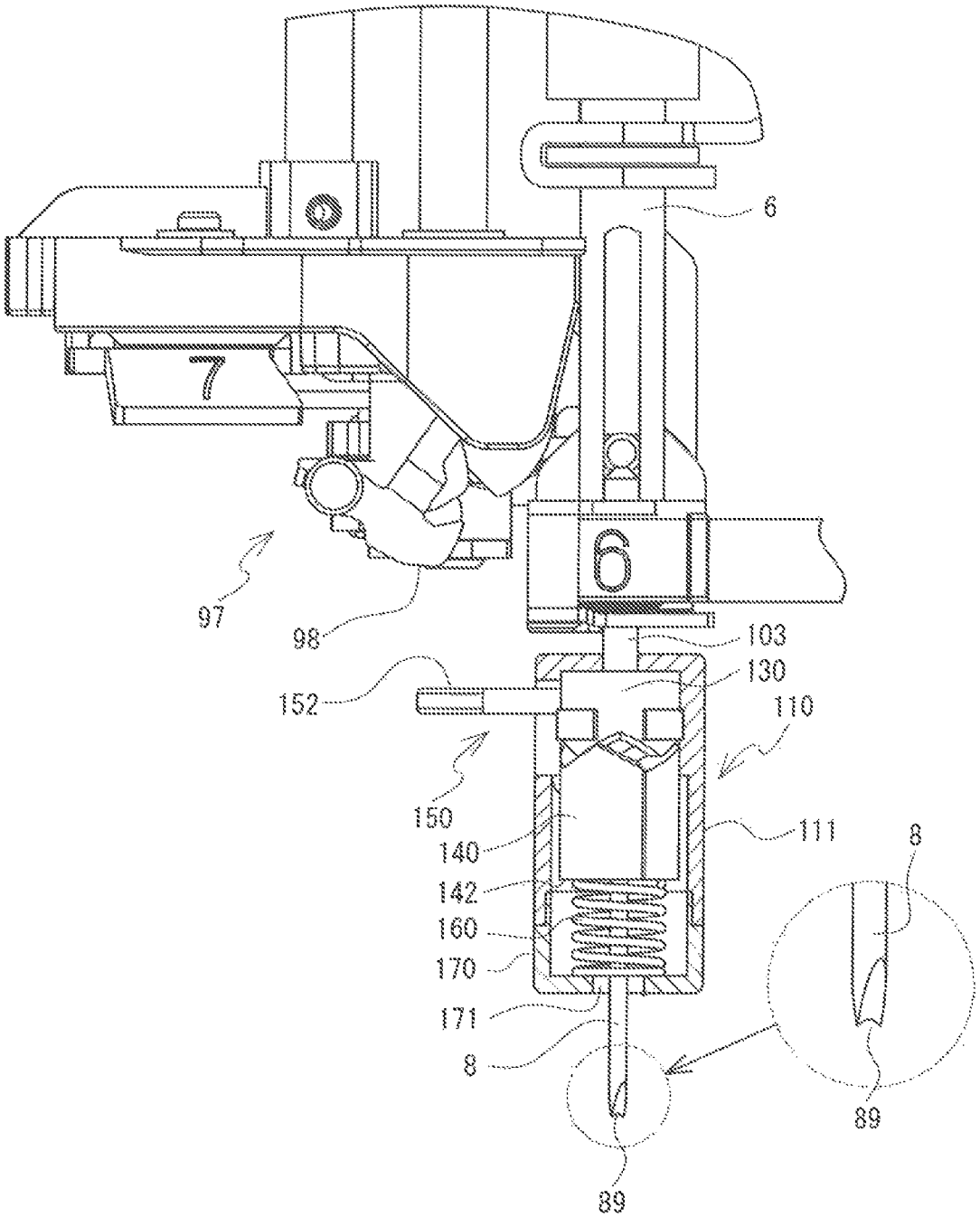
FIG. 21 is a front view that shows operation of the cutting needle rotation device 110.

Next, the CPU 151 operates the threading motor 96 by controlling the drive circuit 78, lowering the threading member 98 of the automatic threading mechanism 97. The lower edge of the automatic threading mechanism 97 thus comes into contact with the contact portion 152 of the moving member 150, as shown in FIG. 20, pressing the moving member 150 downward against the energizing force of the spring 160. The downward pressing of the moving member 150 moves the second member 130 and the first member 140 downward and compresses the spring 160. At this time, the second projecting portions 132 of the second member 130 move down to the lower ends of the recessed portions 115 of the third member 111, and a state is created in which the upper end of the first projecting portion 143 of the first member 140 is no longer fitted into one of the recessed portions 115 of the third member 111, as shown in FIG. 19 (2). Then, because the first member 140 is constantly receiving the upward energizing force of the spring 160, the inclined surfaces 145 of the first cam 146 of the first member 140 move upward and to the right along the inclined surfaces 134 of the second cam 133 of the second member 130, as shown in FIG. 19 (3). (In a plan view, the first member 140 rotates counterclockwise around the axis of the support shaft 103.) More specifically, the first member 140 moves upward and rotates to a position where the inclined surfaces 145 of the first cam 146 of the first member 140 overlap completely with the inclined surfaces 134 of the second cam 133 of the second member 130. Next, the CPU 151 operates the threading motor 96 by controlling the drive circuit 78, raising the threading member 98 of the automatic threading mechanism 97 such that the threading member 98 moves away from the contact portion 152, as shown in FIG. 21. The first member 140 and the second member 130, receiving the upward energizing force of the spring 160, thus move upward within the third member 111. Here, in order to make the explanation easier to understand, the second member 130 will be described as moving upward first, with the first member 140 moving upward thereafter. First, the second projecting portions 132 of the second member 130 move upward to the upper portions of the recessed portions 115 of the third member 111, as shown in FIG. 19 (4). Next, the inclined surfaces 145 of the first cam 146 of the first member 140 come into contact with the inclined surfaces 117 of the inner wall surfaces 116 of the third member 111, as shown in FIG. 19 (4). Then the inclined surfaces 145 of the first cam 146 of the first member 140 move upward and to the right along the inclined surfaces 117 of the inner wall surfaces 116 of the third member 111. (In a plan view, the first member 140 rotates counterclockwise around the axis of the support shaft 103.) Then the upper end of the first projecting portion 143 of the first member 140 fits into one of the recessed portions 115 of the third member 111, as shown in FIG. 19 (5). Therefore, the first member 140 is locked such that it cannot rotate around the axis of the support shaft 103 in relation to third member 111. In this manner, when the threading member 98 presses down on the contact portion 152 one time, the first projecting portion 143 of the first member 140 moves to the neighboring recessed portion 115 of the third member 111 from the recessed portion 115 into which it had been fitted. Note that the recessed portions 115 of the third member 111 are provided in four locations at 90-degree intervals, as described previously. Therefore, when the threading member 98 presses down on the contact portion 152 one time, the first member 140 and the cutting needle 8 rotate 90 degrees counterclockwise in a plan view. Then, in the state described above, the needle bar 6 is lowered and the cut work is performed.

In the explanation above, in order to simplify the explanation of the operation, a simple configuration was explained that rotates the cutting needle 8 counterclockwise 90 degrees at a time in a plan view. However, the first projecting portion 143 and the first cam 146 of the first member 140, the second projecting portions 132 and the second cam 133 of the second member 130, and the recessed portions 115 and the inclined surfaces 117 of the third member 111 are actually configured such that the cutting needle rotation device 110 rotates the cutting needle 8 counterclockwise 45 degrees at a time in a plan view. Furthermore, the sewing machine 1 operates such that it rotates the cutting needle 8 counterclockwise 45 degrees at a time in a plan view, as will be described later.

Figure 22:
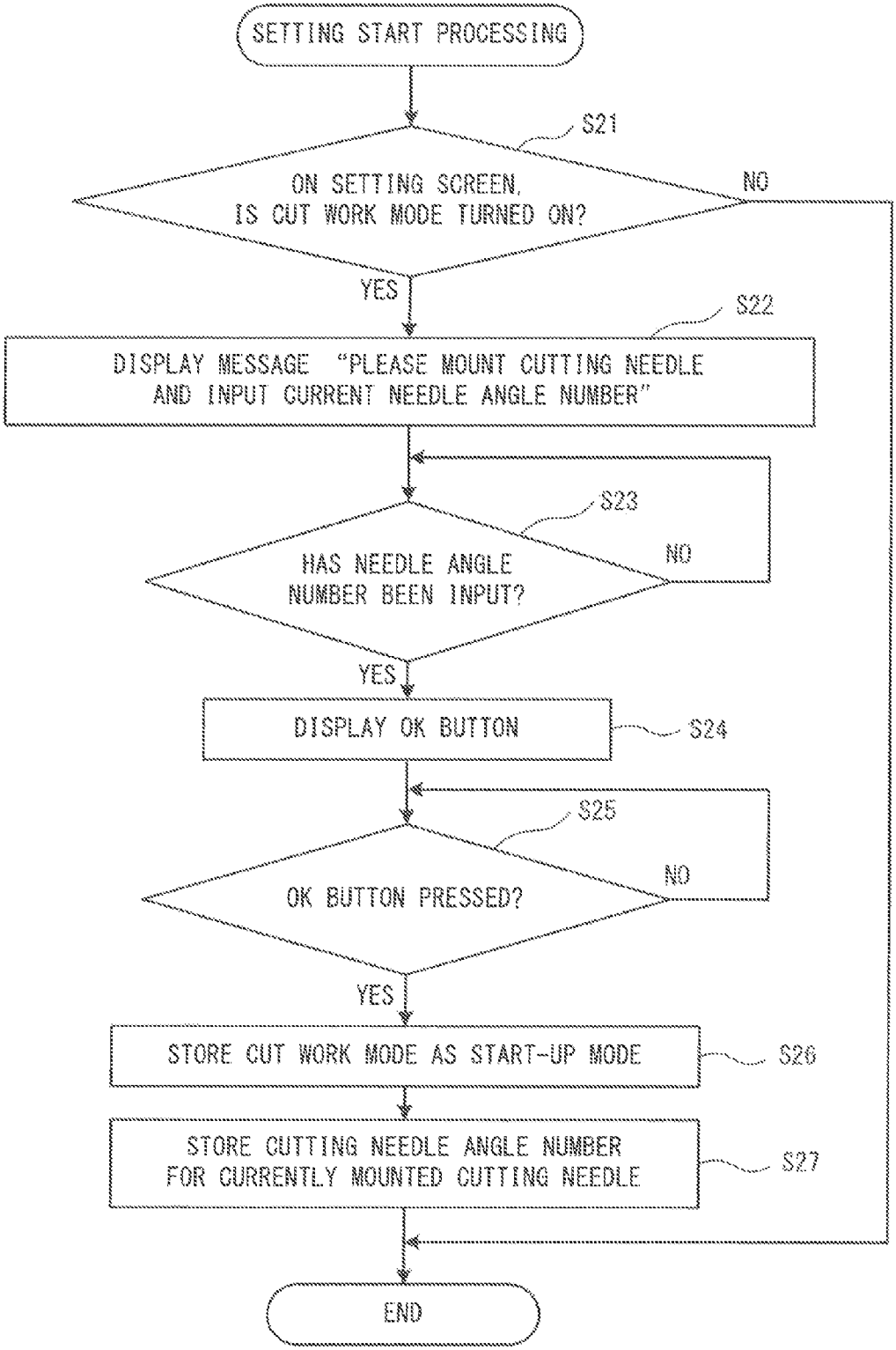
FIG. 22 is a flowchart of setting start processing.

Next, setting start processing that the CPU 151 performs will be explained with reference to FIG. 22. The setting start processing is processing that is performed in advance, prior to the cut work processing. The power supply to the sewing machine 1 is turned on, the touch panel 26 is operated, and a setting screen is displayed on the liquid crystal display 15. If the touch panel 26 is operated to turn on the cut work mode on the setting screen (YES at Step S21), the CPU 151, by controlling the drive circuit 76, displays a message on the liquid crystal display 15 that reads "Please mount cutting needle and input current needle angle number" (Step S22). When the touch panel 26 is operated and one of the needle angle numbers "1", "2", "3", and "4" is input for the cutting needle (YES at Step S23), the CPU 151 controls the drive circuit 76 to display an OK button on the liquid crystal display 15 (Step S24).

Next, when the touch panel 26 is operated and the OK button is pressed (YES at Step S25), the CPU 151 stores the cut work mode as a start-up mode in the start-up mode storage area 644 of the flash memory 64. Specifically, the CPU 151 stores a flag in the start-up mode storage area 644 of the flash memory 64 that indicates the cut work mode (Step S26). The start-up mode is the mode at the time that the sewing machine 1 is started by the turning on of the power supply to the sewing machine 1. The cut work mode is the mode in which the sewing machine 1 performs cut work. Next, the CPU 151 takes the cutting needle angle number that was input for the currently mounted cutting needle 8 and stores it in the cutting needle angle number storage area 645 of the flash memory 64 (Step S27). Next, the CPU 151 terminates the setting start processing. Note that in a case where it is determined at Step S23 that no cutting needle angle number has been input (NO at Step S23), the processing returns to Step S23. Further, in a case where it is determined at Step S25 that the OK button has not been pressed (NO at Step S25), the processing returns to Step S25.

Figure 23:
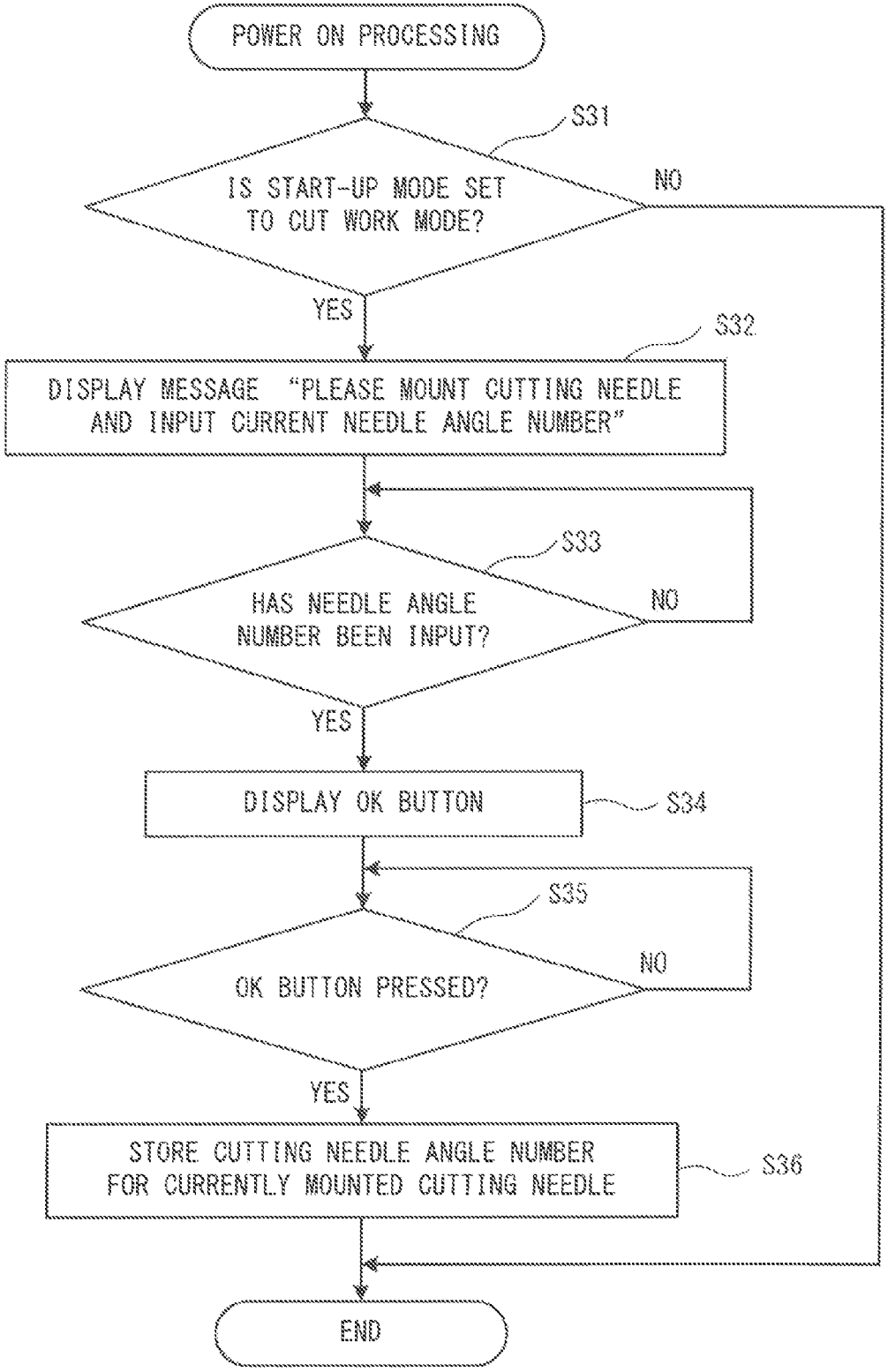
FIG. 23 is a flowchart of power on processing.

Next, power on processing will be explained with reference to the flowchart that is shown in FIG. 23. The power on processing is processing that the CPU 151 performs in a case where the power supply to the sewing machine 1 is turned on by the operating of a power switch that is not shown in the drawings. When the power supply is turned on, the CPU 151 first determines whether or not the start-up mode is set to the cut work mode (Step S31). The CPU 151 determines whether or not the start-up mode is set to the cut work mode based on the flag that is stored in the start-up mode storage area 644 of the flash memory 64 (Step S31). In a case where the start-up mode is set to the cut work mode (YES at Step S31), the CPU 151, by controlling the drive circuit 76, displays a message on the liquid crystal display 15 that reads "Please mount cutting needle and input current needle angle number" (Step S32). When the touch panel 26 is operated and one of the needle angle numbers "1", "2", "3", and "4" is input for the cutting needle (YES at Step S33), the CPU 151 controls the drive circuit 76 to display the OK button on the liquid crystal display 15 (Step S34). Next, when the touch panel 26 is operated and the OK button is pressed (YES at Step S35), the CPU 151 takes the cutting needle angle number that was input for the currently mounted cutting needle 8 and stores it in the cutting needle angle number storage area 645 of the flash memory 64 (Step S36). Note that in a case where it is determined at Step S33 that no cutting needle angle number has been input (NO at Step S33), the processing returns to Step S33. Further, in a case where it is determined at Step S35 that the OK button has not been pressed (NO at Step S35), the processing returns to Step S35.

Figure 24:
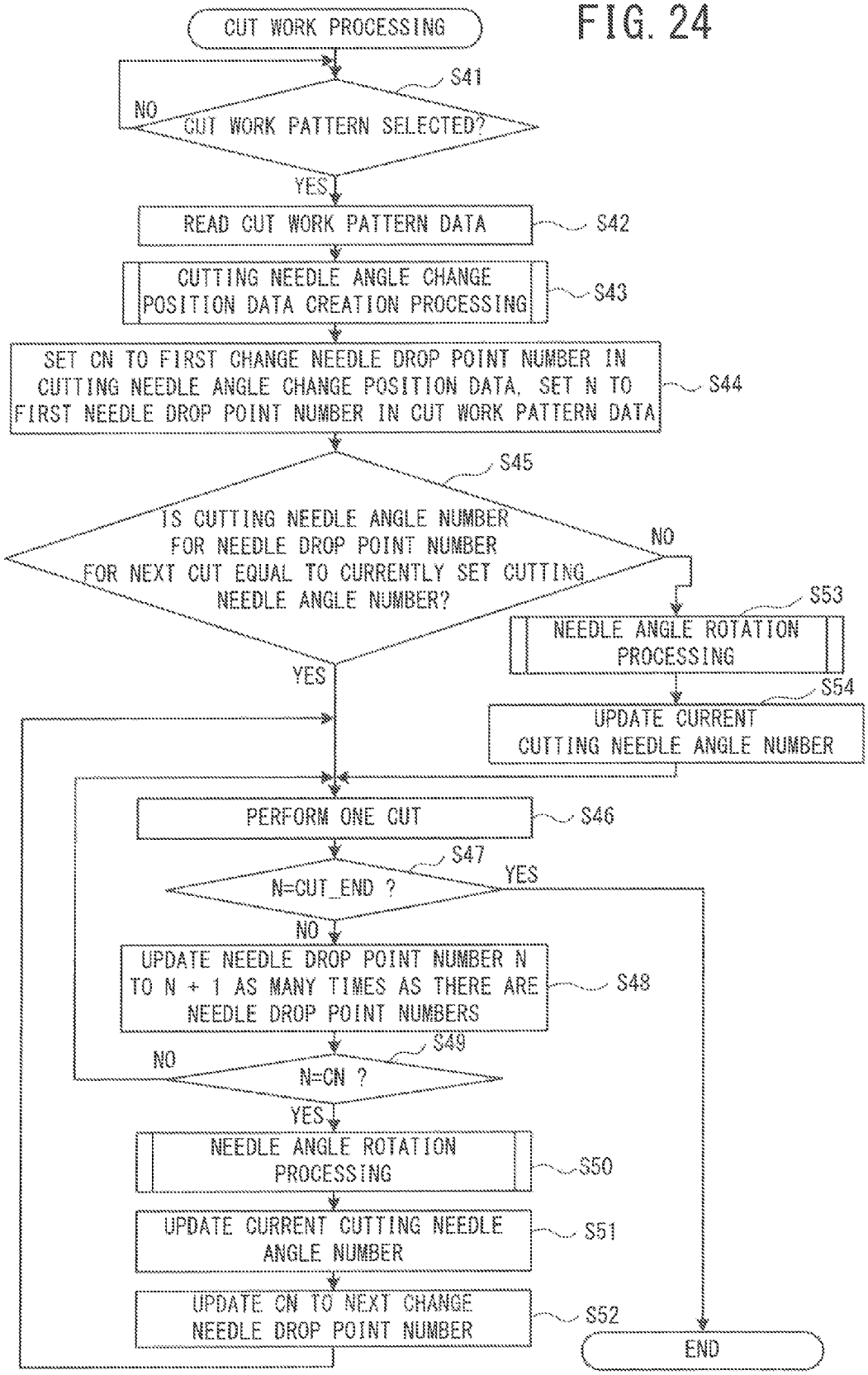
FIG. 24 is a flowchart of cut work processing.

Next, the cut work processing will be explained with reference to the flowchart in FIG. 24. The cut work processing is started when the power supply to the sewing machine 1 is turned on and the user uses the operation switches 35 and the touch panel 26 to input a command. When the CPU 151 of the sewing machine 1 detects the input of the command to start the cut work processing, the CPU 151 reads into the RAM 153 a program for performing the cut work processing that has been stored in the cut work program storage area 646 of the flash memory 64 (refer to FIG. 15). Then, in accordance with the instructions that are contained in the program, the CPU 151 performs the processing at the individual steps that will hereinafter be explained. Using the operation switches 35 and the touch panel 26, the user selects a cut work pattern to be formed on the cloth (not shown in the drawings) and issues a command to perform the cut work.

In the cut work processing, when the touch panel 26 is operated and the cut work pattern is selected (YES at Step S41), the CPU 151 reads the cut work pattern data 100 (Step S42). The CPU 151 refers to the cut work data storage area 641 and reads the cut work pattern data 100 that correspond to the cut work pattern that the user has selected (Step S42). Next, the CPU 151 performs cutting needle angle change position data creation processing (Step S43).

Figure 25:
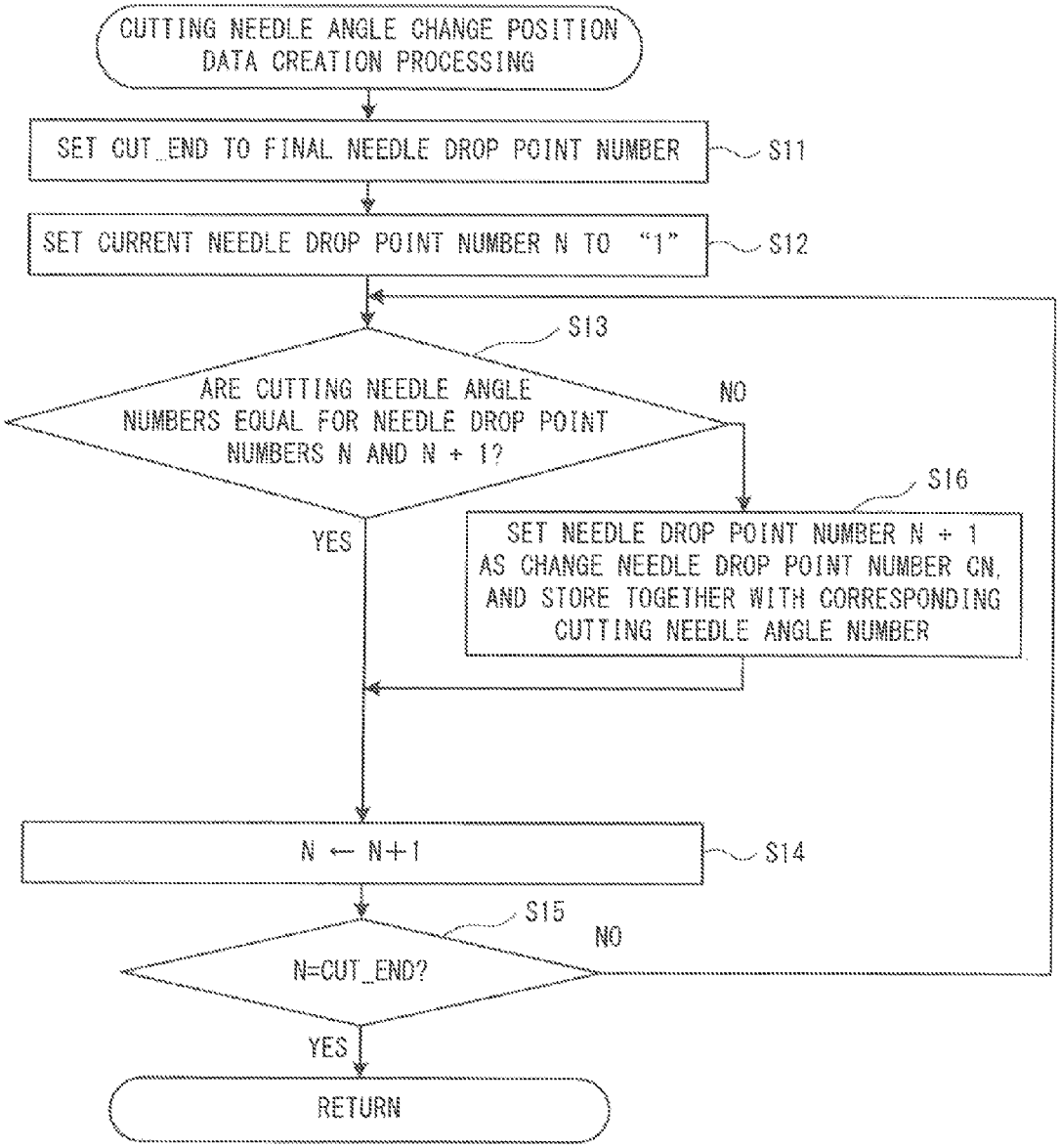
FIG. 25 is a flowchart of cutting needle angle change position data creation processing.

The cutting needle angle change position data creation processing will be explained with reference to the flowchart in FIG. 25. The cutting needle angle change position data creation processing is processing that creates data for the positions where the angle of the cutting needle 8 will be changed, based on the cut work pattern data 100 that are shown in FIG. 16, for example. First, the CPU 151 sets the value "CUT_END" to the final needle drop point number (Step S11). For example, if the final needle drop point number is "30", "CUT_END" will be set to "30". The value "30" is stored as the value "CUT_END" in the RAM 153 (Step S11). Next, the CPU 151 sets the current needle drop point number N to 1 (Step S12). The value 1 for the current needle drop point number N is stored in the RAM 153. Next the CPU 151 determines whether or not the cutting needle angle number for the needle drop point number N is equal to the cutting needle angle number for the needle drop point number N+1 (Step S13). In a case where the cutting needle angle number for the needle drop point number N is equal to the cutting needle angle number for the needle drop point number N+1 (YES at Step S13), the angle of the cutting needle 8 does not need to be changed, so the CPU 151 increments the current needle drop point number N by 1 (Step S14). Next, the CPU 151 determines whether or not the current needle drop point number N is equal to the value of "CUT_END" that was set at Step S11 (Step S15). In a case where the current needle drop point number N is not equal to the value of "CUT_END" (NO at Step S15), the CPU 151 returns the processing to Step S13.

In a case where the cutting needle angle number for the needle drop point number N is not equal to the cutting needle angle number for the needle drop point number N+1 (NO at Step S13), the CPU 151 defines the needle drop point number N+1 as the corresponding change needle drop point number CN and stores it in the cutting needle angle change position data 102 together with the corresponding cutting needle angle number (Step S16). For example, in the cut work pattern data 100 that are shown in FIG. 16, the cutting needle angle number "2" for the needle drop point number N value 5 is not equal to the cutting needle angle number "1" for the needle drop point number N+1 value 6 (NO at Step S13). Therefore, as shown in FIG. 18, the CPU 151 stores the needle drop point number N+1 value 6 as the change needle drop point number CN value 6 and stores the corresponding cutting needle angle number "1" (Step S16).

Next, the CPU 151 increments the current needle drop point number N by 1 (Step S14). Then the CPU 151 determines whether or not the current needle drop point number N is equal to the value of "CUT_END" that was set at Step S11 (Step S15). In a case where the current needle drop point number N is not equal to the value of "CUT_END" (NO at Step S15), the CPU 151 returns the processing to Step S13. The CPU 151 repeats the processing described above until the current needle drop point number N is equal to the value of "CUT_END". For example, in the cut work pattern data 100 that are shown in FIG. 16, the cutting needle angle number changes in the cases where the needle drop point number N is 6, 9, and 13. Therefore, the cutting needle angle change position data 102 that are shown in FIG. 18 are created by the cutting needle angle change position data creation processing that is described above. Next, at Step S15, in a case where the current needle drop point number N is equal to the value of "CUT_END" (YES at Step S15), the CPU 151 advances the processing to Step S44 of the cut work processing.

Next, the CPU 151 sets the change needle drop point number CN to the first change needle drop point number CN in the cutting needle angle change position data 102 (refer to FIG. 18) that were created by the processing at Step S43 (refer to FIG. 18) and sets the needle drop point number N to the first needle drop point number N in the cut work pattern data 100 (refer to FIG. 16) (Step S44). In the present embodiment, the change needle drop point number CN is 6, and the needle drop point number N is 1 (Step S44). Next, the CPU 151 determines whether or not the cutting needle angle number for the needle drop point number N where the next cut will be made is equal to the currently set cutting needle angle number (Step S45). For example, in the cut work pattern data 100 that is shown in FIG. 16, the cutting needle angle number is "2" for the needle drop point number N value 1, and the cutting needle angle number is also "2" for the needle drop point number N value 2, where the next cut will be made. Therefore, the CPU 151 determines that the cutting needle angle number for the needle drop point number N where the next cut will be made is equal to the currently set cutting needle angle number (YES at Step S45). Next, the CPU 151 controls the drive circuits 70 to 75 such that the cutting needle 8 makes one cut in the cloth (Step S46). Next, the CPU 151 determines whether or not the needle drop point number N is equal to the value of "CUT_END" (Step S47). In a case where the needle drop point number N is equal to "CUT_END" (YES at Step S47), it means that the final cut has been made in the cloth, so the CPU 151 terminates the cut work processing.

Figure 26:
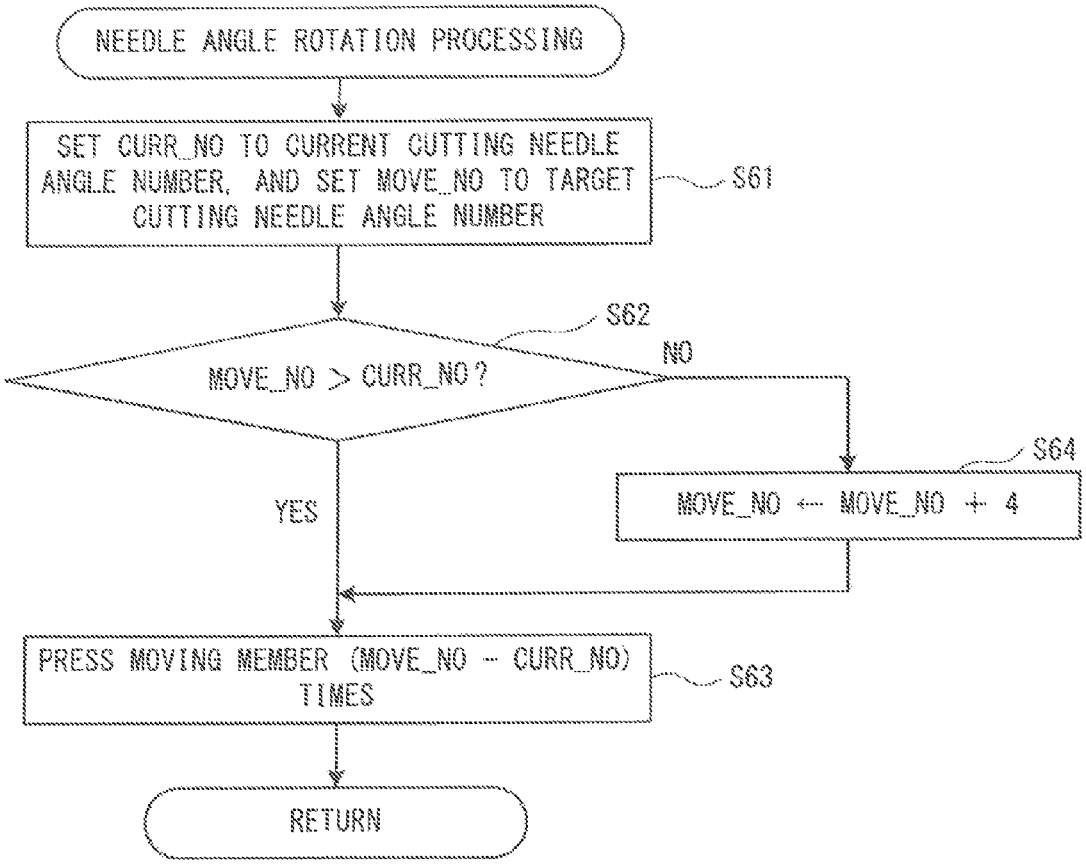
FIG. 26 is a flowchart of needle angle rotation processing.

In a case where the needle drop point number N is not equal to "CUT_END" (NO at Step S47), the CPU 151 updates the needle drop point number N to N+1 (Step S48). Next, in a case where the needle drop point number N is not equal to the change needle drop point number CN (NO at Step S49), the CPU 151 returns the processing to Step S46. In a case where the needle drop point number N is equal to the change needle drop point number CN (YES at Step S49), the CPU 151 performs the needle angle rotation processing (Step S50). The needle angle rotation processing (Step S50) will be explained with reference to the flowchart in FIG. 26. In the needle angle rotation processing, first, the CPU 151 sets a value CURR_NO to the current cutting needle angle number and sets a value MOVE_NO to the cutting needle angle number to which the cutting needle 8 will be rotated (Step S61). For example, in a case where the current cutting needle angle number CURR_NO is "2" and the cutting needle angle number MOVE_NO to which the cutting needle 8 will be rotated is "1", MOVE_NO is not greater than CURR_NO (NO at Step S62), so the value of MOVE_NO is increased to MOVE_NO+"4" (Step S64). In this example, MOVE_NO+"4" equals "5" (Step S64). Here, "4" is added to MOVE_NO because the cutting needle 8 will rotate 180 degrees when the moving member 150 is pressed four times.

In a case where the value of MOVE_NO is greater than the value of CURR_NO (YES at Step S62), as well as in a case where Step S64 has been performed, the CPU 151, by controlling the drive circuit 78 to operate the threading motor 96, performs the operation that moves the threading member 98 of the automatic threading mechanism 97 downward, such that it presses down on the contact portion 152 of the moving member 150 of the cutting needle rotation device 110, the operation being repeated a number of times that is equal to the difference between the value of MOVE_NO and the value of CURR_NO (Step S63). In the example that is described above, the value of MOVE_NO is "5", and the value of CURR_NO is "2", so the difference between the value of MOVE_NO and the value of CURR_NO is "3". Therefore, the CPU 151 performs the operation that moves the threading member 98 of the automatic threading mechanism 97 downward, such that it presses down on the contact portion 152 of the moving member 150 of the cutting needle rotation device 110, a total of three times.

Next, the CPU 151 returns to the cut work processing and updates the current cutting needle angle number (Step S51). In the example described above, the current cutting needle angle number is updated to "1" (Step S51). The change needle drop point number CN is also updated to the next change needle drop point number (Step S52). For example, the CPU 151 refers to the cutting needle angle change position data 102 that are shown in FIG. 18 and updates the change needle drop point number CN to "9" (Step S52). Next, the CPU 151 returns the processing to Step S46. Next, the CPU 151 controls the drive circuits 70 to 75 such that the cutting needle 8 makes one cut in the cloth (Step S46). Next, in a case where the needle drop point number N is equal to "CUT_END" (YES at Step S47), it means that the final cut has been made in the cloth, so the CPU 151 terminates the cut work processing.

Note that in the determination processing at Step S45, in a case where it has been determined that the cutting needle angle number for the needle drop point number N where the next cut will be made is not equal to the currently set cutting needle angle number (NO at Step S45), the CPU 151 performs the needle angle rotation processing (Step S53). The needle angle rotation processing (Step S53) is the same processing as the previously described needle angle rotation processing (Step S50), so an explanation will be omitted. When the needle angle rotation processing (Step S53) ends, the CPU 151 updates the current cutting needle angle number (Step S54). The processing at Step S54 is the same processing as the processing at Step S51, so an explanation will be omitted. Once the processing described above is performed, the cut work processing is terminated.

As explained above, just by controlling the drive circuit 78 to operate the threading motor 96 and move the automatic threading mechanism 97 up and down, the CPU 151 of the sewing machine 1 is able to move the moving member 150 of the cutting needle rotation device 110 up and down and thereby rotate the cutting needle 8. Therefore, the cutting needle 8 can be rotated and cut work can be performed simply by mounting the cutting needle rotation device 110 on the known sewing machine 1, without providing any specialized mechanism.

Figure 27:
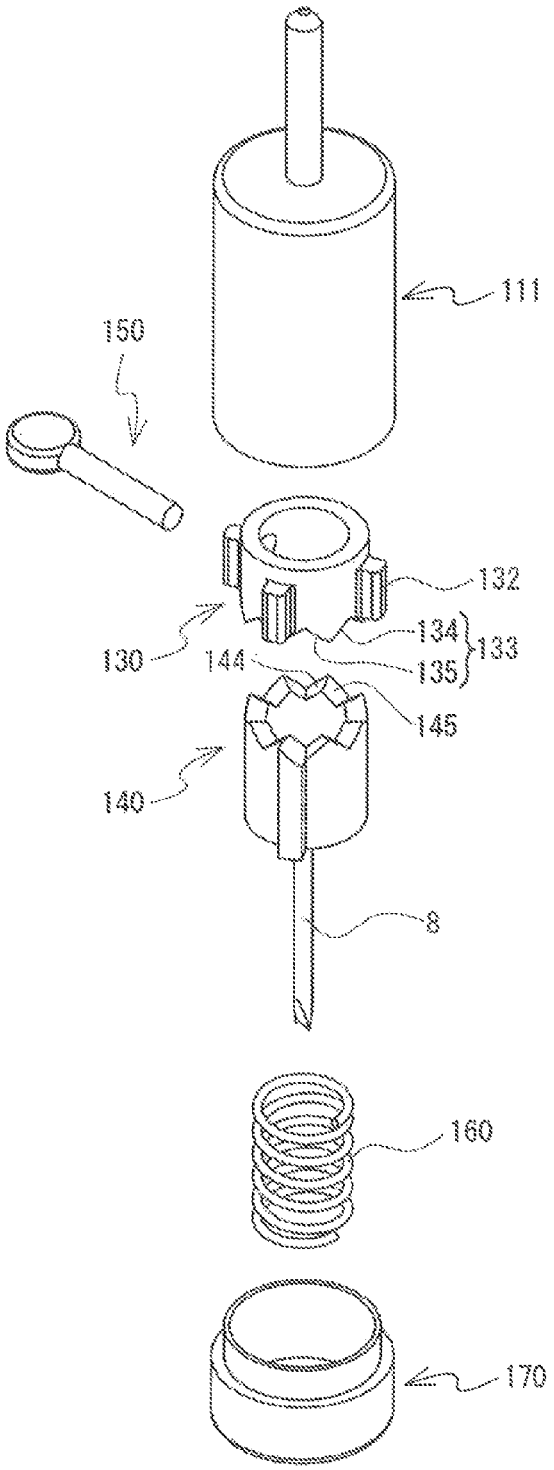
FIG. 27 is an exploded oblique view of a different example of the cutting needle rotation device 110.

Note that the present disclosure is not limited to the embodiment that is described above, and various types of modifications can be made. For example, the shapes, the sizes, and the angles of the inclined surfaces of the first cam 146 of the first member 140 and the second cam 133 of the second member 130 may each be modified as desired. In the embodiment that is described above, in the explanations that refer to FIG. 2, FIGS. 4 to 14, and FIG. 19, to facilitate showing the shapes of the individual structural members of the cutting needle rotation device 110 in a way that is easy to understand, a configuration was explained that rotates the cutting needle 8 in 90-degree increments in a plan view. In the case of a configuration that rotates the cutting needle 8 in 45-degree increments in a plan view, all that would be required would be for eight of the recessed portions 115 of the third member 111 to be provided at equal intervals, four of the second projecting portions 132 of the second member 130 to be provided at equal intervals, eight pairs of the inclined surfaces 134 and the inclined surfaces 135 of the second cam 133 of the second member 130 to be provided at equal intervals, and eight pairs of the inclined surfaces 144 and the inclined surfaces 145 of the first cam 146 of the first member 140 to be provided at equal intervals, as shown in FIG. 27. In the case of a configuration that rotates the cutting needle 8 in 60-degree increments in a plan view, what would be required would be for six of the recessed portions 115 of the third member 111 to be provided at equal intervals, six of the second projecting portions 132 of the second member 130 to be provided at equal intervals, six pairs of the inclined surfaces 134 and the inclined surfaces 135 of the second cam 133 to be provided at equal intervals, and six pairs of the inclined surfaces 144 and the inclined surfaces 145 of the first cam 146 of the first member 140 to be provided at equal intervals.

What is claimed is:

1. A cutting needle rotation device, comprising:

a mounting portion that is removably mounted on a needle bar of a sewing machine;

a first member that is a member to which a cutting needle is affixed at an opposite end of the first member from the mounting portion, wherein the cutting needle is provided with a cutting edge;

a moving member that is positioned in a first position when the moving member does not receive an external force and that moves to a second position when the moving member receives an external force; and a rotation mechanism that, when the moving member is in the first position, holds the first member such that the cutting needle does not rotate about an axis of the cutting needle, and that, when the moving member moves from the first position to the second position and returns from the second position to the first position, rotates the first member such that the cutting needle rotates about the axis of the cutting needle axis by a specified angle of rotation in one direction.

2. The cutting needle rotation device according to claim 1, wherein the rotation mechanism is provided with the first member, a second member, a third member, a cover member, and an elastic member, the first member is formed into a cylindrical shape, and is provided with a needle anchoring portion, a first cam, and a first projecting portion, the needle anchoring portion is provided on one end and is a portion where a base end of the cutting needle is affixed, the first cam is provided on the other end, the first projecting portion is provided on an outer circumferential face of the first member, the second member is formed into a cylindrical shape, and is provided with a second cam that comes into contact with the first cam, and a second projecting portion on an outer circumferential face of the second member, the third member is formed from a cylinder that has an open portion on one end, with the other end being closed, and is provided with a plurality of recessed portions on an inner circumferential face of the third member, a guide opening on an outer circumferential face of the third member, and the mounting portion at the other end, and accommodates the first member and the second member inside the cylinder, the plurality of the recessed portions are provided at specified intervals, with a specified length parallel to the axial direction of the cylinder, with each one of the recessed portions being capable of holding the first projecting portion such that the first projecting portion does not rotate, the guide opening has a specified length parallel to the axial direction of the cylinder and guides the moving member such that the moving member is capable of moving parallel to the axial direction of the cylinder, with at least a tip of the moving member being exposed, the cover member is provided with an affixing portion by which the cover member is affixed to the open portion of the third member, thereby closing the open portion, and is provided with a through-hole through which the cutting needle passes, and the elastic member is accommodated inside the third member, is provided between the cover member and the first member, and energizes the first member toward the mounting portion, together with the second member.

3. A sewing machine comprising:

a cutting needle rotation device that includes a mounting portion that is removably mounted on a needle bar of the sewing machine;

a first member that is a member to which a cutting needle is affixed at an opposite end of the first member from the mounting portion, the cutting needle being provided with a cutting edge;

a moving member that is positioned in a first position when the moving member does not receive an external force and that moves to a second position when the moving member receives an external force; and a rotation mechanism that, when the moving member is in the first position, holds the first member such that the cutting needle does not rotate about an axis of the cutting needle, and that, when the moving member moves from the first position to the second position and returns from the second position to the first position, rotates the first member such that the cutting needle rotates about the axis of the cutting needle axis by a specified angle of rotation in one direction.

4. The sewing machine according to claim 3, further comprising:

a threading device that is provided with a threading member and an actuator, wherein the threading member is configured to pass a thread through an eye of a sewing needle that is removably mounted on a needle bar, and is supported such that the threading member is capable of moving between an upper standby position and a lower threading position, and the actuator is configured to move the threading member between the upper standby position and the lower threading position;

a processor; and a memory storing computer-readable instructions, wherein the instructions, when executed by the processor, perform processes comprising:

an acquiring operation acquiring cutting data for cutting of a cloth by the cutting needle; and a controlling operation controlling, in a state in which the cutting needle rotation device is mounted on the needle bar such that the tip of the moving member is opposite the threading member, the actuator based on data for an angle direction of the cutting needle that is included in the acquired cutting data, and such that:

(i) the actuator moves the threading member to come into contact with the tip of the moving member for moving the moving member from the first position to the second position, and (ii) the actuator moves the threading member to move away from the tip of the moving member for returning the moving member from the second position to the first position, thereby rotating the cutting needle.

* * * * *